United States Patent [19]

Kaneko et al.

[11] Patent Number: 4,531,442

[45] Date of Patent: Jul. 30, 1985

[54] SOUND BOARD ASSEMBLY FOR AN UPRIGHT PIANO

[75] Inventors: Yasutoshi Kaneko; Hideo Yamashita, both of Shizuoka, Japan

[73] Assignee: Nippon Gakki Seizo Kabushiki Kaisha, Japan

[21] Appl. No.: 594,352

[22] Filed: Mar. 28, 1984

[51] Int. Cl.[3] ..... G10C 3/06

[52] U.S. Cl. ..... 84/195

[58] Field of Search ..... 84/184, 185, 186, 187, 84/188, 192, 195

[56] References Cited

FOREIGN PATENT DOCUMENTS

2890/26 of 1926 Australia ..... 84/195

*Primary Examiner*—L. T. Hix

*Assistant Examiner*—Douglas S. Lee

*Attorney, Agent, or Firm*—Ostrolenk, Faber, Gerb & Soffen

[57] ABSTRACT

In construction of a sound board assembly for an upright piano, a unitary rectangular sound board support includes an outer bank corresponding to the conventional sound board base and a rearwardly stepped inner bank corresponding to the conventional base frame in order to remove necessity for surface finish and enable easy and free position adjustment at attachment of a sound board.

5 Claims, 4 Drawing Figures

SOUND BOARD ASSEMBLY FOR AN UPRIGHT PIANO

BACKGROUND OF THE INVENTION

The present invention relates to an improved sound board assembly for an upright piano, and more particularly relates to a sound board assembly for an upright piano made up of reduced number of components and producible with reduced number of operational steps for lowering in production cost.

In the following description, the fore side of a component refers to the side of the component near the front side of an upright piano in which the component is built.

It is well known that a sound board is used for an upright piano in order to transmit vibration energy of strings widely over its entire area for generation of rich musical tones.

In construction of an upright piano, a sound board in a vertical position is attached to the fore side surface of a sound board support which is made up of a sound board base and a base frame. The sound board base and the base frame both have rectangular constructions each of which is made up of four side bar like members connected to each other at four corner junctions. Due to unavoidable work and connection errors, steps are liable to be developed at the corner junctions and presence of such steps hinders tight and close attachment of the sound board to the sound board base and the sound board base to the base frame. Removal of such steps at the corner junctions necessitates application of surface finish during production of the sound board assembly. This apparently connects to increase in number of operational steps in the production. Further, a sound board is usually provided on its rear side surface with a number of ribs which extend in a direction normal to the grain direction for total directional transmission of the string vibration energy. Conventionally, each rib terminates at edges of the sound board. So, for snag surface contact of the sound board to the sound board base, some recesses must be formed in the fore side surface of the sound board base in order to receive the projecting rib ends on the rear side surface of the sound board. Formation of such rib rests further increases the number of operational steps in the production.

At attachment of the sound board to the sound board support, it is desirable that their relative position can be adjusted somewhat. In the case of the above-described construction, rib ends projecting on the sound board are quite snugly received within rib rests formed in the sound board base, and there is no room for even a slight adjustment in position.

SUMMARY OF THE INVENTION

It is one object of the present invention to provide a sound board assembly for an upright piano which can be produced by reduced operational steps from reduced number of components.

It is another object of the present invention to provide a sound board assembly for an upright piano which allows adjustment in position between a sound board and a sound board support at their attachment in production.

In accordance with the basic aspect of the present invention, a sound board is provided with a plurality of elongated ribs which are attached to the rear side surface of the sound board with their ends being distant from the edge of the sound board, a sound board support attached to the rear side surface of the sound board takes the form of a rectangular frame which is made up of four side bars connected to each other at four corner junctions of the rectangular frame, each side bar is made up of an outer bank and an inner bank stepped rearwards from the outer bank, the width of the outer bank is smaller than the minimum distance between the ends of the ribs and the edge of the sound board bearing the ribs, each bar is provided at its one end in one corner junction with a tenon extending in its thickness direction, an adjacent bar is provided at its one end in the same corner junction with a mortice extending in its thickness direction, the tenon on the one bar is snugly received in the mortice in the adjacent bar, and ends of the ribs on the sound board are located in a space between the rear side surface of the sound board and the front side surfaces of the inner banks of the side bars of the sound board support.

DESCRIPTION OF THE PREFERRED EMBODIMENTS

Figure 1:
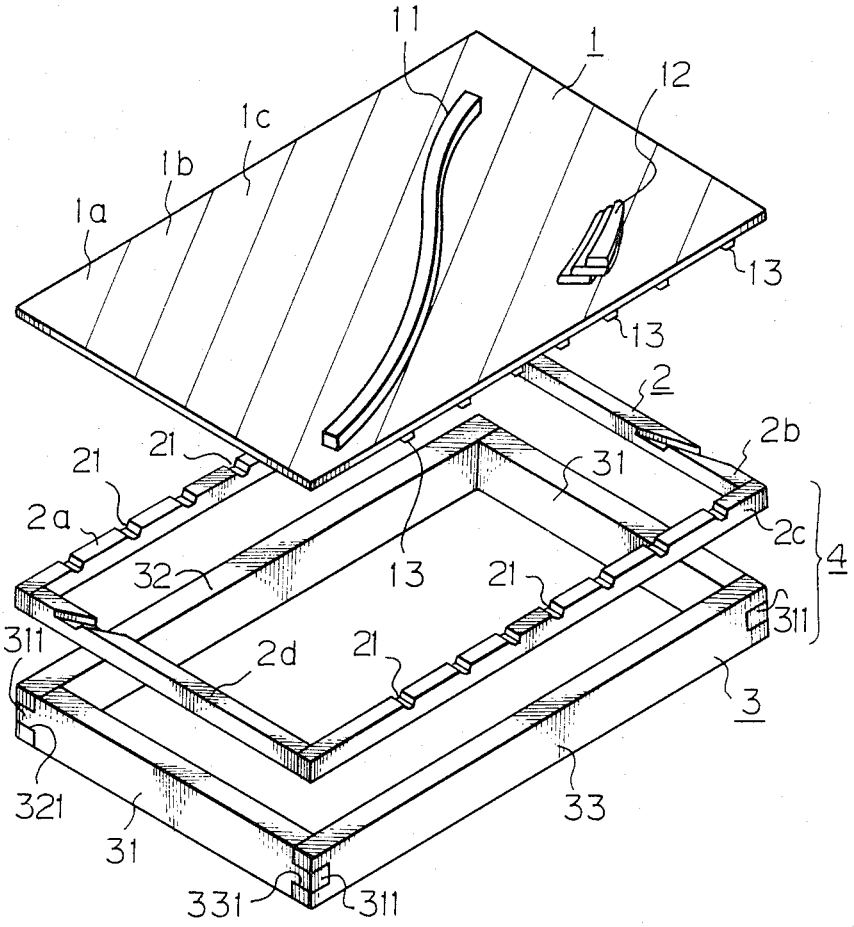
Fig. 1 PRIOR ART
FIG. 1 is a perspective view of one example of the conventional sound board assembly in a disassembled state.

One typical example of the conventional sound board assembly is shown in FIG. 1, in which a sound board assembly includes, as major components, a sound board 1, a sound board base 2 and a base frame 3. The sound base 2 combined with the base frame 3 forms a sound board support 4 to be attached to the rear side of the sound board 1.

The sound board 1 is given in the form of a rectangular plate and expected to transmit vibration energy of strings stretched thereon over the entire area thereof for generation of musical tones. The material, construction and arrangement of the sound board is believed to have a great influence on the tonal quality and tone volume of musical tones to be generated by a piano. The above-described rectangular plate is made up of a plurality of strips 1*a*, 1*b*, 1*c*—joined side by side with their grains running substantially in a same direction. The strips are made of woods having small specific gravity, high elasticity and rich softness. Usually, Yedo spruce or spruce is used. A treble bridge 11 is bonded to the fore side surface of the sound board 1 about the middle of the latter whilst extending in the direction of the grains. A bass bridgh 12 is also bonded to the fore side surface of the sound board 1 near a bottom corner of the latter. A plurality of, more specifically from 7 to 15, ribs 13 are bonded to the rear side surface of the sound board at proper intervals. The ribs 13 extend in a direction substantially normal to the direction of the grains. The ribs 13 are used first for transmission of the string vibration energy in the sound board 1 across the grains and, secondly, for reinforcement of the sound board 1. The sound board 1 is attached to the fore side of the sound board support 4 whilst standing almost upright.

The sound board support 4 includes the sound board base 2 which is given in the form of a rectangular frame made up of 4 side bars *2a* to *2d*. Top and bottom side bars *2a* and *2c* are provided with same number of rib rests 21 in the form of transverse grooves. When the sound board 1 is attached to the sound board support 4, the rib rests 21 receive ends of the ribs 13 on the rear side surface of the sound board 1.

The sound board support 4 further includes the base frame 3 which is rectangular in shape. The base frame 3 is made up of a pair of rear posts 31, a cross-beam 32 and a ground still 33. Each of the junctions at four corners of the base frame 3 includes a tenon 311 formed at one end of the rear post 31 and a mortice 321 or 331 formed at an associated end of the cross-beam 32 or 33. That is, a tenon on a post is received in and bonded to a corresponding mortice in a cross-beam or groundstill.

In production of the above-described conventional sound board assembly, the base frame 3 is first formed by assembling together the rear posts 31, the cross-beam 32 and the ground still 33. Due to unavoidable work error in formation of the tenon 311 and the mortice 321 and 331, steps are likely to be developed at the junctions of the base frame. Presence of such steps hinders tight and close attachment of the sound board base 2 to the base frame 3. In order to avoid this trouble, surface finish has to be applied to the fore side surface of the base frame 3. After removal of the steps, the sound board base 2 is bonded to the finished fore side surface of the base frame 3. Since the sound board base 2 is also made up of four side bars *2a* to *2d* connected to each other at their ends, the corner junctions of the sound board base 2 also likely include steps due to connection and/or work error. Presence of such steps hinders tight and close attachment of the sound board 1 to the sound board base 2. In order to avoid this trouble, surface finish has to be applied to the four side surface of the sound board base 2. After removal of the steps, rib rests 21 are formed in the fore side surface of the sound board base 2 in order to complete the sound board support 4. Finally, the sound board 1 is attached to the fore side surface of the sound board support 4 in a manner such that the ends of the ribs 13 on the sound board 1 should be snugly received in the rib rests 21 in the sound board base.

In conclusion, production of the conventional sound board assembly includes seven major operational steps using three major components. Further, at attachment of the sound board 1 with the sound board support 4, there is no possibility of free position adjustment because of the snug engagement of the rib ends with the rib rests.

Figure 2:
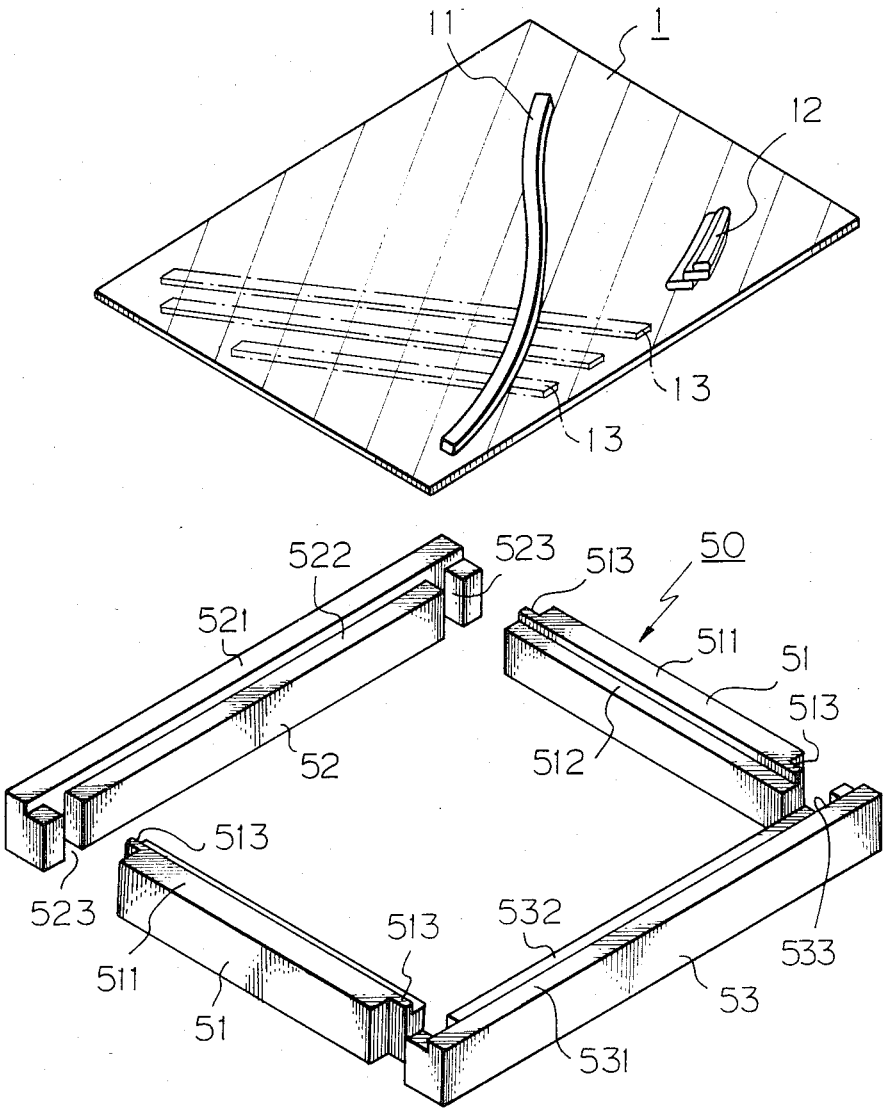
FIG. 2 is a perspective view of one embodiment of the sound board assembly in accordance with the present invention in a disassembled state.

One embodiment of the sound board assembly in accordance with the present invention is shown in FIG. 2, in which the sound board assembly includes, like the one shown in FIG. 1, includes a sound board 1. The sound board 1 includes a treble bridge 11, a bass bridge 12 and a plurality of ribs 13 attached to the rear side surface of the sound board 1 as shown with chain lines. In the case of this embodiment, however, the ribs 13 terminate at positions distant from the edge of the sound board 1.

The sound board assembly further includes a sound board support 50 in the form of a rectangular frame which is made up of four side bars 51 to 53. The first side bars 51 correspond to the rear posts 31 in FIG. 2, the second side bar 52 corresponds to the cross-beam 32 in FIG. 1, and the third side bar 53 corresponds to the ground still 33 in FIG. 1. These side bars 51 to 53 are, however, basically same in construction except for difference in length. So, although the following explanation is focussed on the second side bar 52, the explanation can be applied to other side bars 51 and 53. The second side bar 52 is made up of an outer bank 521 and an inner bank 522 having an upper surface at a lower level than the upper surface of outer bank 521. Likewise, the first side bar 51 is made up of an outer bank 511 and an inner bank 512, and the third side bar 53 includes an outer bank 531 and an inner bank 532.

The four side bars 51 to 53 are connected to each other at four corner junctions of the rectangular frame. The first side bar 51 is provided at its one end in one corner junction with a tenon 513 whose width is less than the width of bar 51 and whose length is equal to the height of bar 51. Here, the thickness direction of a side bar refers to a direction normal to a plane coplanar with the rear side surface of the side bar. The second side bar 52 is provided at its one end in one corner junction with a mortice 523 which extends to the full in the thickness direction of the side bar 51.

In the case of the illustrated embodiment, a side bar is provided at its both ends with tenons and an adjacent side bar is provided at its both ends with mortices snugly receptive of the side bar. This combination can be changed quite freely. In one alternative example, a side bar is provided at its one end with a tenon and at its other end with a mortice.

Figure 4:
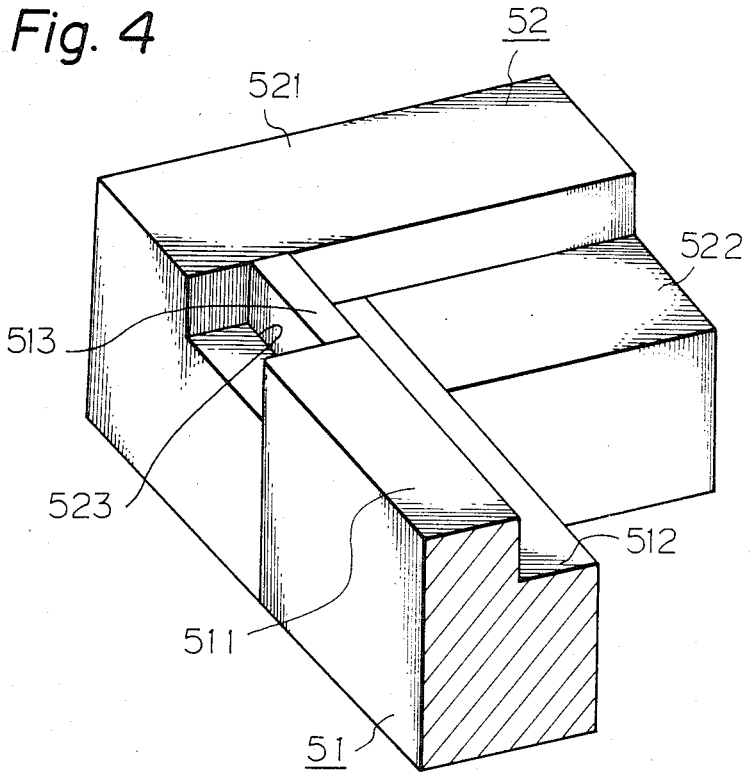
FIG. 4 is a perspective view of a corner junction of the sound board support in the sound board assembly shown in FIG. 2.

In any case, the combination of a tenon on one side bar with a mortice in another side bar forms a corner junction of the rectangular frame. One example of such a junction is shown in FIG. 4, in which the first and second side bars 51 and 52 are connected to each other at the corner junction. As is clear in the illustration, the tenon 513 formed at one end of the first side bar 51 is snugly received in and bonded to the mortice 523 formed at the associated end of the second side bar 52.

Figure 3:
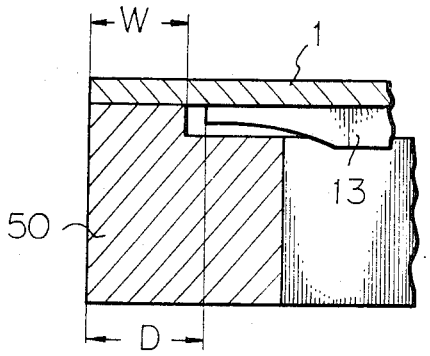
FIG. 3 is a sectional view of an attachment of a sound board to a sound board support in the sound board assembly shown in FIG. 2.

As stated above, the end of each rib 13 on the sound board 1 terminates at a position distant from the edge of the sound board 1. More specifically, as shown in FIG. 3, the width W of the outer bank of the sound board support 50 is smaller than the minimum distance D between the ends of the ribs 13 and the edge of the sound board 1 bearing the ribs 13. As a consequence, ends of the ribs 13 on the sound board 1 are located in a space between the rear side surface of the sound board and the front side surface of the sound board support.

In production of the sound board assembly in accordance with the present invention, the four side bars 51 to 53 are assembled together at the four corner junctions. At this assemblage, the fore side surfaces of the four side bars are easily made flash with each other by moving them relative to each other in the thickness direction of the sound board support 50 before final bonding. Directions of the tenons and mortices allow such relative movement in the thickness direction. As a consequence, it is no longer necessary to apply surface finish to the sound board support 50 in advance to attachment of the sound board 1.

Since the outer bank of the sound board support 50 plays the role of the sound board base 2 used for the conventional sound board assembly, it is no longer necessary to take one additional operational step for formation of the sound board support.

At attachment of the sound board 1 to the sound board support 50, space accommodation of rib ends shown in FIG. 3 allows easy and free adjustment in position of the sound board 1 before final bonding.

We claim:

1. An improved sound board assembly for an upright piano comprising a sound board provided with a plurality of elongated ribs which are attached to the rear side surface of said sound board, and a sound board support which is attached to the rear side surface of said sound board and made up of four side bars connected at longitudinal ends thereof to each other to form a rectangular frame having four corner junctions, each said side bar being made up of an outer bank and a inner bank having an upper surface which is lower than an upper surface of said outer bank.

2. An improved sound board assembly as claimed in claim 1 in which each said corner junction includes a tenon extending from one longitudinal end of a side bar and a mortice recessed in one longitudinal end of an associated side bar, and said tenon is snugly received in said mortice.

3. An improved sound board assembly as claimed in claim 2 in which each said tenon has a width which is less than the width of the side bar from which it extends.

4. An improved sound board assembly as claimed in claim 1 in which each end of said rib terminates at a position distant from the edge of said sound board.

5. An improved sound board assembly as claimed in claim 4 in which the width of said outer bank of said each side bar is smaller than the minimum distance between ends of said ribs and said edge of said sound board.

* * * * *